United States Patent [19]

Kovaleski

[11] 3,995,758

[45] Dec. 7, 1976

[54] SPOOL-HANDLING DOLLY

[76] Inventor: Joseph J. Kovaleski, c/o Wyrepak Industries, Inc., 136 James St., Bridgeport, Conn. 06604

[22] Filed: Mar. 31, 1975

[21] Appl. No.: 563,792

[52] U.S. Cl. ..... 214/330; 214/654; 242/79; 242/128; 214/DIG. 3; 214/DIG. 4

[51] Int. Cl.[2] ..... B60B 29/00; B65G 47/00; B21C 47/24

[58] Field of Search ..... 214/330–331, 214/333, 340, 654, DIG. 3, DIG. 4; 242/128, 79

[56] References Cited

UNITED STATES PATENTS

| | | | |
|---|---|---|---|
| 2,807,382 | 9/1957 | Schenkelberger | 214/654 X |
| 2,999,654 | 9/1961 | Fuller | 242/128 |
| 3,035,812 | 5/1962 | Wintees | 214/331 X |
| 3,069,107 | 12/1962 | Hirt | 242/79 |
| 3,174,634 | 3/1965 | Peck | 214/77 X |
| 3,638,877 | 2/1972 | Clark et al. | 242/128 |
| R24,958 | 3/1961 | Ehmann | 214/674 |

FOREIGN PATENTS OR APPLICATIONS

| | | | |
|---|---|---|---|
| 1,220,076 | 5/1960 | France | 214/654 |
| 93,742 | 2/1959 | Norway | 214/654 |
| 714,482 | 9/1954 | United Kingdom | 214/654 |
| 1,639,910 | 6/1959 | U.S.S.R. | 214/330 |

*Primary Examiner*—Robert J. Spar
*Assistant Examiner*—R. B. Johnson
*Attorney, Agent, or Firm*—H. Gibner Lehmann; K. Gibner Lehmann

[57] ABSTRACT

A spool-handling dolly consisting of a simple U-shaped chassis mounted on wheels and arranged to be wheeled over a floor surface. The chassis has an upright post and slide, along which there is movable a carrige that is raised and lowered by a drive means comprising a vertical screw and a handwheel. The wheel has a lifting shoulder or projection which is adapted to be inserted in the bore of a filled spool that is positioned with both its flanges resting on the floor surface. The carriage also has a clamp jaw adapted to cooperate with the lifting shoulder in a manner to clamp an upper portion of one of the spool flanges securely to the carriage. A guide means on the carriage enables the clamp jaw to be vertically adjusted for this purpose. There is a second drive means on the carriage, engaged with the clamp jaw for moving the same along the guide means in its vertical travel. After the second drive means has been operated to clamp the spool securely to the carriage, the first drive means is operated to raise the carriage so as to lift the spool completely off the floor surface. The dolly and spool can then be wheeled to the desired location. The carriage includes an over-arm, at the extremity of which there is a pay-off pulley located to receive wire that is uncoiled from that end of the spool which is not clamped to the carriage.

2 Claims, 3 Drawing Figures

SPOOL-HANDLING DOLLY

BACKGROUND OF THE INVENTION

This invention relates to equipment for handling wire and like products which are stored on spools. In the larger sizes, industrial spools can become extremely heavy, especially when filled or wound with metal wire and the like. Customarily such spools have been rolled over the supporting floor surface to the desired location, after which they were lifted and mounted on a rack or other supporting device to enable the wire to be uncoiled from the spool for use. Such procedure was laborious and time consuming, requiring personnel capable of heavy work in addition to the machine operators who are assigned to tend the equipment for which the wire is intended. In some instances, the handling of such large and heavy spools has resulted in injury to workers, as well as damage to property in cases where the movements of the spools could not be readily controlled.

SUMMARY

The above disadvantages and drawbacks of prior methods for handling heavy, fully or partially filled spools is obviated by the present invention, which has for its main object the provision of a novel and improved spool-handling dolly that eliminates the need for especially strong workmen and instead enables unskilled helpers who are capable of only light factory work to readily manipulate large, filled spools, transporting these to the desired locations and positioning them so that the wire can be readily paid out at the designated equipment.

A related object of the invention is to provide an improved spool-handling dolly as above set forth, which is especially simple in its construction, easy to operate and manipulate, and which is strong, rugged and durable, being capable of handling even large and heavy spools with comparative ease and convenience.

A feature of the invention resides in the provision of a spool-handling dolly of the kind indicated, which can be readily economically fabricated from available structural shapes and parts.

The above objects are accomplished by the provision of a U-shaped chassis provided with wheels located at the extremities of the legs of the U, and with a third wheel in the form of a large caster that is attached to the middle or yoke portion of the U. The chassis has an upright slide in the form of a box section which extends upward from its yoke and mounts a vertically movable carriage which is actuated by a first drive means in the form of a vertical screw operated by a handwheel. The carriage has a lifting shoulder which is adapted to fit into one end of the bore of a spool while the latter is resting on the floor surface, on both of its flanges. A guide means on the carriage is cooperable with a clamp jaw that is located above the lifting shoulder, the jaw being vertically shifted by a second drive means, this one being on the carriage and also operable by a handwheel. When the lifting shoulder is inserted in the bore of the spool, the clamp jaw is shifted downward so as to engage the upper rim portion of a flange of the spool and securely clamp the same to the carriage. The operator then actuates the first drive means so as to lift the carriage and the clamped spool off the floor, after which the dolly can be readily wheeled to the desired location where the wire is to be removed from the spool for use. The carriage also has an over-arm at the end of which there is a pay-off pulley adapted to receive and guide the wire that is being taken off the spool past the other flange thereof (that one which is not clamped to the carriage).

Still other features and advantages will hereinafter appear.

Figure 1:
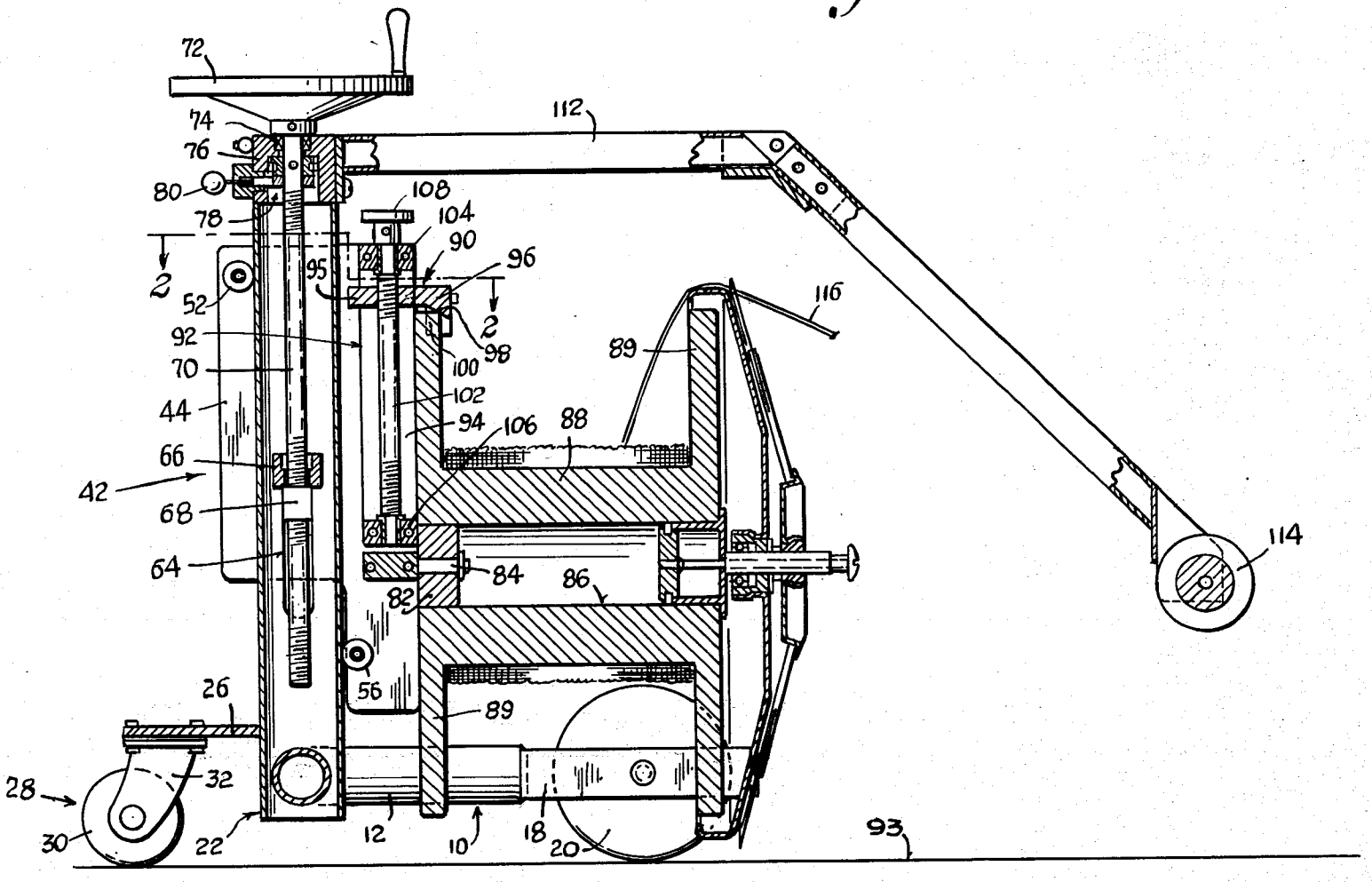
FIG. 1 is a view partly in elevation and partly in vertical section, of the spool-handling dolly of the invention.

As shown, the improved dolly of the invention comprises a chassis designated generally by the numeral 10, made up of straight tubular sections 12, 14 and tubular angle members 16 so as to have the shape of the letter U. Attached to the extremities of the legs or tubular sections 12 of the chassis are saddles 18 which carry wheels 20 supported in suitable bearings (not shown). At the center or yoke portion 14 of the chassis 10 there is secured an upright slide 22 which is preferably formed of a pair of channel members 24 assembled to form a box section, with their abutting edges welded together. Attached to the lower portion of the upright slide 22 is a horizontal metal bracket 26, to which there is secured a caster 28 comprising a small wheel 30 and a bearing fixture 32. The wheels 20, 30 provide a 3-point support for the chassis 10, as will be understood.

The various metal forms and parts shown are securely welded to each other to form a rigid and sturdy assemblage which will withstand considerable stress and strain, yet the structure is seen to be simple and economical to fabricate.

In accordance with the invention, the box section or slide 22 is so arranged that its exterior surfaces on opposite sides of the welds can be utilized as four tracks 34, 36, 38 and 40, and a unique carriage 42 is provided, comprising a pair of side plates 44, 46 disposed on opposite sides of the slide 22. The carriage 42 includes tie rods 48, 50 which mount rollers 52, 54, 56 and 58. The upper rollers 52, 54 respectively engage the tracks 34, 36 of the slide 22, whereas the lower rollers 56, 58 engage the tracks 38, 40 of the slide.

Additionally, as provided by the invention, the carriage 42 has tie means or members 60, 62 which extend through vertical slots 64 in the webs of the channels 24 which constitute the slide 22 and are rigidly secured to a drive collar or fitting 66 which is engaged with a nut 68 adapted to travel along a vertical screw 70 located within the slide.

At its upper end, the screw 70 carries a handwheel 72, and is supported by suitable anti-friction bearings 74 which are mounted in a top fitting or cap 76 secured to the slide 22. Within the cap 76, the screw 70 carries a ratchet device 78 which is engagable by a locking plunger 80 movable in the cap 76. The ratchet device 78 and plunger 80 automatically prevent retro-grade turning movement of the screw 70 when the carriage 42 is being raised by the latter. Also, the plunger 80 can be pulled outward and turned to lock it out of engagement with the ratchet device 78 during such times that it is desired to lower the carriage 42 by reversing movement of the screw.

It will be understood that, by the provision of the vertical screw 70, nut 68 and follower or drive collar 66 (which latter is connected with the tie members 60, 62)

there is had a first drive means by which turning of the handwheel 72 and screw 70 will effect raising and lowering movements of the carriage 42.

In accordance with this invention, the carriage 42 is provided with a lift shoulder which can be in the form of a circular block 82 carried on a stud 84 that is mounted between the side plates 44, 46 of the carriage 42. The lift shoulder 82 is sized so as to enable it to be inserted in the bore 86 of a spool (such as the spool 88) which is resting on the floor surface (designated) 93.

Figure 2:
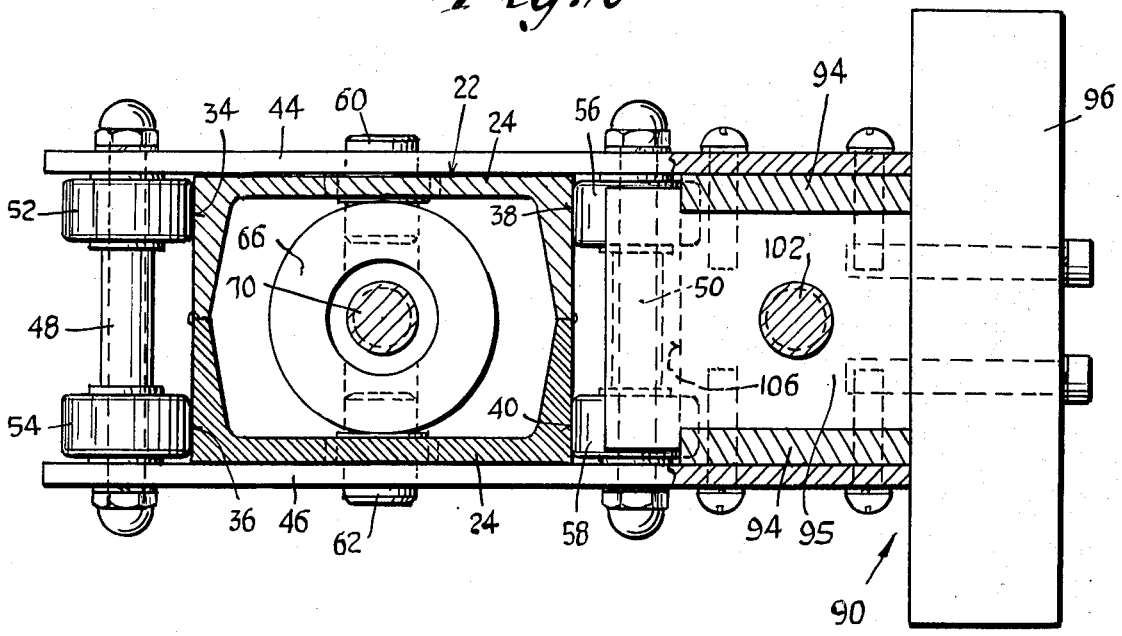
FIG. 2 is a fragmentary horizontal section taken on the line 2—2 of FIG. 1.
Figure 3:
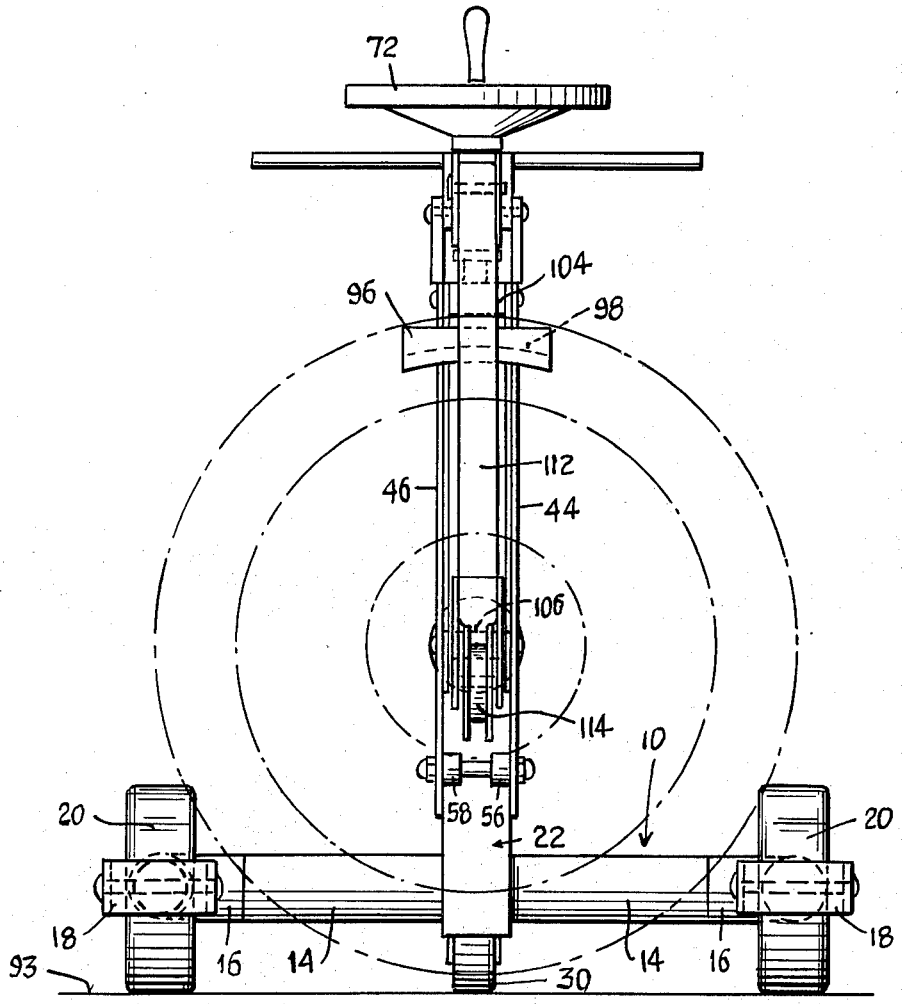
FIG. 3 is a front elevational view of the spool-handling dolly.

The carriage 42 also slidably mounts a clamp jaw 90 above the lift shoulder 82, such jaw being vertically movable in a guide means 92 comprising vertically-extending, spaced-apart metal plates 94 which are secured between the side plates 44, 46 of the carriage. The clamp jaw 90 is secured to a slider 95 which closely slidably fits between the guide plates or rails 94 as seen in FIG. 2. The clamp jaw 90 is, according to the invention, in the form of a nest, comprising a curved portion 96 seen in FIG. 3 which has a bevel 98. As illustrated in FIG. 1, the jaw (or nest) 90 is thus enabled to clamp against the upper flange portion 100 of the spool 88, securely holding such flange portion to the front edges of the guide rails 94.

The slider 95 is internally threaded, and travels along a vertical drive screw 102 which is mounted in end bearings of 104, 106 secured to the carriage 42 between the side plates 44, 46 thereof. At its upper extremity, the screw 102 has a handwheel 108 by which it can be turned. The handwheel 108, screw 102 and slider 95 constitute a second drive means, this one carried by the carriage 42 and so arranged as to shift the clamp jaw 90 vertically between the rails 94 of the guide means 92.

It will now be understood from the foregoing that with the spool 88 resting on the floor surface 93 and both flanges 89 engaged with the floor it is possible to bring up the dolly to straddle both sides of the spool and thereafter to insert the lift shoulder 82 in the spool bore 86. The chassis legs 12 will be located at both sides of the spool for this purpose, in a manner similar to that illustrated in FIG. 1. With the lift shoulder 82 fully engaged, the operator turns the handwheel 108 so as to shift downward the clamp jaw 90 and securely clamp the spool flange portion 100 to the carriage 42, specifically against the front edges of the upright rails 94 and carriage side plates 44, 46. When this has been done, the operator turns the larger handwheel 72 with the ratchet device 78 in its operative condition, so as to lift the carriage 42 and raise the spool 88 from the floor, to the position illustrated in FIG. 1.

Thereafter, the carriage and spool can be wheeled to any desired location adjacent equipment which is to utilize the wire.

The invention further provides on the chassis 10 an over-arm 112 which is attached to the cap fitting 76 directly under the handwheel 72, such overarm having a pay-off pulley 114 adapted to receive wire 116 which is being removed from the spool past the foremost flange 89 thereof (that not clamped).

It will now be understood from the foregoing that I have provided a novel and improved spool-handling dolly which reduces materially the labor required to shift about large and heavy, fully wound spools of wire, and required to mount these spools adjacent the equipment intended to use the wire, all in a manner such that the wire can be readily removed from the spool. The dolly is simple in its construction, durable and rugged, and can be easily and quickly operated by personnel hired to do light factory work.

Variations and modifications are possible without departing from the spirit of the invention.

I claim:

1. A spool-handling dolly comprising, in combination:

a. a chassis including wheels for moving the chassis over a floor surface, b. said chassis including an upright slide in the form of a box section provided with vertical slots and constituted of two channels having vertical abutting edges welded together along central portions of the box section, c. a carriage vertically movable along said upright slide and constituted of a pair of spaced-apart metal plates disposed on opposite sides of the slide, and further constituted of tie rods extending between and connected with said metal plates, said tie rods being disposed exteriorly of said slide, d. a first drive means on the chassis, for raising and lowering said carriage, said first drive means comprising an upright screw extending within the slide, and a nut threaded on the screw, e. a lift shoulder carried by the carriage and adapted to be inserted in the bore of a filled spool located with its flanges resting on the floor surface, f. an arm carried by the chassis and extending over the lift shoulder, g. a pay-off pulley mounted at the end of the arm in registration with the lift shoulder, h. a clamp jaw on the carriage, disposed above said lift shoulder and adapted to cooperate with the same to clamp a portion of the spool and an upper portion of one flange thereof, i. guide means on the carriage and clamp jaw, enabling the latter to be vertically adjusted on the carriage, j. a second drive means engaged with the clamp jaw, for moving the same along the guide means, k. said second drive means being operable to clamp the spool to the carriage and said first drive means being operable to raise the carriage so as to lift the spool off the floor surface, l. said slide having pairs of tracks along its exterior, the tracks of the pairs being disposed on opposite sides of the vertical, abutting welded edges of the slide, m. said carriage having a pair of rollers on its upper portion, engaged with two of said tracks, and having a pair of rollers on its lower portion, engaged with the other two tracks, said pairs of rollers being carried on said tie rods, n. said first drive means further including tie members extending through the vertical slots of the slide and connected with said metal plates and with said nut to transmit motion from the latter to said carriage, o. said first drive means including a drive collar attached to said nut and encircling said screw.

2. A spool-handling dolly as in claim 1, wherein:

a. the clamp jaw comprises a nest adapted to cradle said upper flange portion of the spool in a manner to prevent unintentional dislodgement of the spool, b. said nest comprising a curved portion provided with a bevel.

* * * * *